US011809207B2

(12) United States Patent
Nakatani et al.

(10) Patent No.: US 11,809,207 B2
(45) Date of Patent: Nov. 7, 2023

(54) TEMPERATURE COMPENSATION CIRCUIT AND SEMICONDUCTOR INTEGRATED CIRCUIT USING THE SAME

(71) Applicant: Winbond Electronics Corp., Taichung (TW)

(72) Inventors: Masafumi Nakatani, Kanagawa (JP); Kimihisa Hiraga, Yamanashi (JP)

(73) Assignee: Winbond Electronics Corp., Taichung (TW)

( * ) Notice: Subject to any disclaimer, the term of this patent is extended or adjusted under 35 U.S.C. 154(b) by 0 days.

(21) Appl. No.: 17/881,639

(22) Filed: Aug. 5, 2022

(65) Prior Publication Data

US 2023/0084920 A1 Mar. 16, 2023

(30) Foreign Application Priority Data

Sep. 14, 2021 (JP) ..... 2021-149138

(51) Int. Cl.
*G05F 3/30* (2006.01)
*G05F 1/567* (2006.01)

(52) U.S. Cl.
CPC ..... *G05F 1/567* (2013.01); *G05F 3/30* (2013.01)

(58) Field of Classification Search
None
See application file for complete search history.

(56) References Cited

U.S. PATENT DOCUMENTS 6,194,957 B1 * 2/2001 Fryer ..... G05F 3/262 327/543
6,664,843 B2 12/2003 Dasgupta et al.
(Continued)

FOREIGN PATENT DOCUMENTS

CN 101950191 5/2012
JP H03160513 7/1991
(Continued)

OTHER PUBLICATIONS

"Office Action of Japan Counterpart Application", dated Jul. 27, 2022, p. 1-p. 4.
(Continued)

*Primary Examiner* — Thomas J. Hiltunen
(74) *Attorney, Agent, or Firm* — JCIPRNET

(57) ABSTRACT

The disclosure provides a temperature compensation circuit that generates a temperature-compensated current and an integrated semiconductor circuit using the temperature compensation circuit. The temperature compensation circuit includes: a first PTAT current source which has a first emitter area ratio and generates a first current, the first current having a first temperature coefficient proportional to the absolute temperature; a second PTAT current source which has a second emitter area ratio and generates a second current, the second current having a second temperature coefficient proportional to the absolute temperature; an adjustment circuit which adjusts the current generated by the first PTAT current source; and a differential circuit which outputs the difference between the current adjusted by the adjustment circuit and the current generated by the second PTAT current source.

19 Claims, 8 Drawing Sheets

(56) References Cited

U.S. PATENT DOCUMENTS

| | | | | |
|---|---|---|---|---|
| 6,717,878 | B2 * | 4/2004 | Hagura | G11C 7/04 365/222 |
| 7,113,044 | B2 * | 9/2006 | Wang | G05F 3/262 330/288 |
| 7,233,214 | B2 * | 6/2007 | Kim | H03K 5/2472 331/34 |
| 7,737,675 | B2 * | 6/2010 | Murase | G05F 3/30 323/314 |
| 7,920,015 | B2 * | 4/2011 | Chellappa | G05F 3/30 327/539 |
| 9,618,958 | B2 * | 4/2017 | Jang | G05F 3/26 |
| 9,996,100 | B2 * | 6/2018 | Shin | G05F 3/242 |
| 10,742,197 | B2 * | 8/2020 | Cai | H03L 1/022 |
| 2009/0201067 | A1 * | 8/2009 | Haneda | G05F 3/30 327/512 |
| 2021/0263547 | A1 * | 8/2021 | Shen | G05F 3/262 |

FOREIGN PATENT DOCUMENTS

| | | |
|---|---|---|
| JP | 2003224466 | 8/2003 |
| JP | 2003273654 | 9/2003 |
| JP | 2005285019 | 10/2005 |
| JP | 2021082094 | 5/2021 |
| JP | 2021110994 | 8/2021 |
| TW | 201303548 | 1/2013 |

OTHER PUBLICATIONS

"Office Action of Japan Counterpart Application", dated Feb. 7, 2023, p. 1-p. 4.

* cited by examiner

TEMPERATURE COMPENSATION CIRCUIT AND SEMICONDUCTOR INTEGRATED CIRCUIT USING THE SAME

CROSS-REFERENCE TO RELATED APPLICATION

This application claims the priority benefit of Japan application serial no. 2021-149138, filed on Sep. 14, 2021. The entirety of the above-mentioned patent application is hereby incorporated by reference herein and made a part of this specification.

BACKGROUND

Technical Field

The present disclosure relates to a temperature compensation circuit that generates temperature-compensated current, particularly a temperature compensation circuit with two proportional-to-absolute-temperature (PTAT) current sources.

Description of Related Art

A temperature-compensated voltage corresponding to the operating temperature is generally generated in a semiconductor device, such as a memory or a logic circuit. The temperature-compensated voltage ensures the reliability of the circuit by keeping the circuit operating. When data is read, if the read current flow decreases due to temperature changes in the memory circuit, then the read tolerance would decrease, preventing data from being read accurately. For example, Patent Document 1 (Japanese Patent Laid-Open No. 2021-82094) discloses a voltage generating circuit that compares a reference voltage VREF and a temperature-dependent voltage VPTAT, and selects one of the reference voltage VREF and the temperature-dependent voltage VPTAT based on the comparison result to generate a highly reliable voltage.

Temperature coefficient (Tco) of a constant current circuit or a constant current source is often a problem in the analog circuit design. For example, as an oscillator includes a delay circuit to determine the period (cycle) of oscillation, a constant current circuit is sometimes adapted as the delay circuit to avoid voltage dependence of the delay time due to fluctuations in the power supply voltage, but the temperature coefficient of the constant current circuit varies in the delay time with respect to the temperature, affecting the period of the oscillator by the temperature.

SUMMARY

The temperature compensation circuit of the disclosure includes: a first circuit employing transistors with a first emitter area ratio or diodes with a number ratio equivalent to the first emitter area ratio to generate a first current having a first temperature coefficient proportional to the absolute temperature; a second circuit employing transistors with a second emitter area ratio or diodes with a number ratio equivalent to the second emitter area ratio to generate a second current having a second temperature coefficient proportional to the absolute temperature; and a differential circuit configured to output a differential current of the first current and the second current.

The semiconductor integrated circuit of the disclosure includes: the temperature compensation circuit described above; and a voltage generation circuit configured to generate a voltage based on the differential current output by the temperature compensation circuit.

According to the disclosure, a high-precision, temperature-compensated current is obtained by generating a difference of currents having different temperature coefficients proportional to the absolute temperature.

DESCRIPTION OF THE EMBODIMENTS

Embodiments of the disclosure are described in detail with reference to the drawings. The temperature compensation circuit of the disclosure may be used in semiconductor integrated circuits, such as a voltage generation circuit for generating a reference voltage, an oscillation circuit, and other logic circuits.

Figure 1:
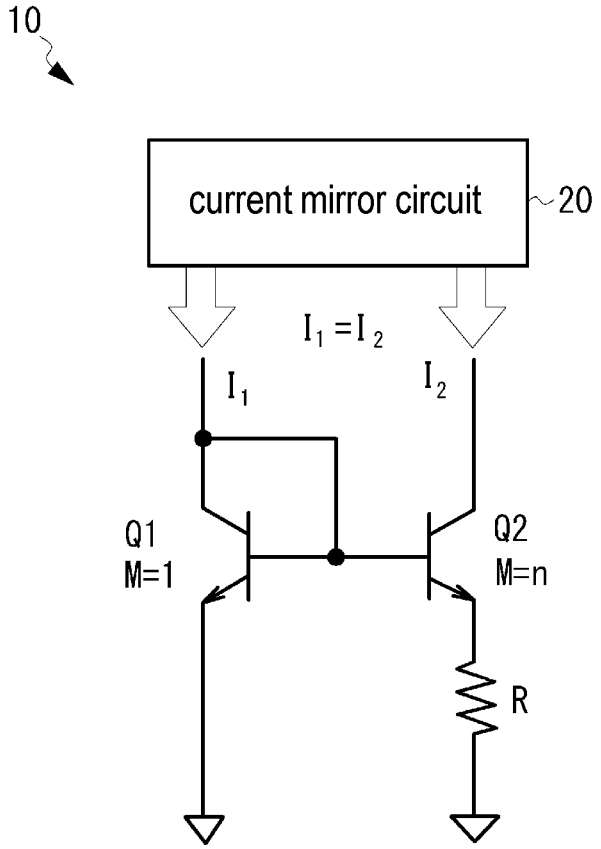
FIG. 1 is a diagram showing an example of a normal PTAT.

FIG. 1 is a diagram showing the configuration of a general PTAT current source. The PTAT current source 10 includes a current mirror circuit 20 that supplies a current $I_1$ and a current $I_2$ to a first current path and a second current path, an NPN bipolar transistor Q1 connected to the first current path, and an NPN bipolar transistor Q2 connected to the second current path, and a resistor R connected between the transistor Q2 and the ground (GND). The output current $I_1$ is made equal to the current $I_2$ to control the current mirror circuit 20. In addition, the emitter area ratio of the diode-connected transistor Q1 to the transistor Q2 is 1:n (n is the emitter area ratio), and the current density of the transistor Q1 is n times that of the transistor Q2.

Figure 2:
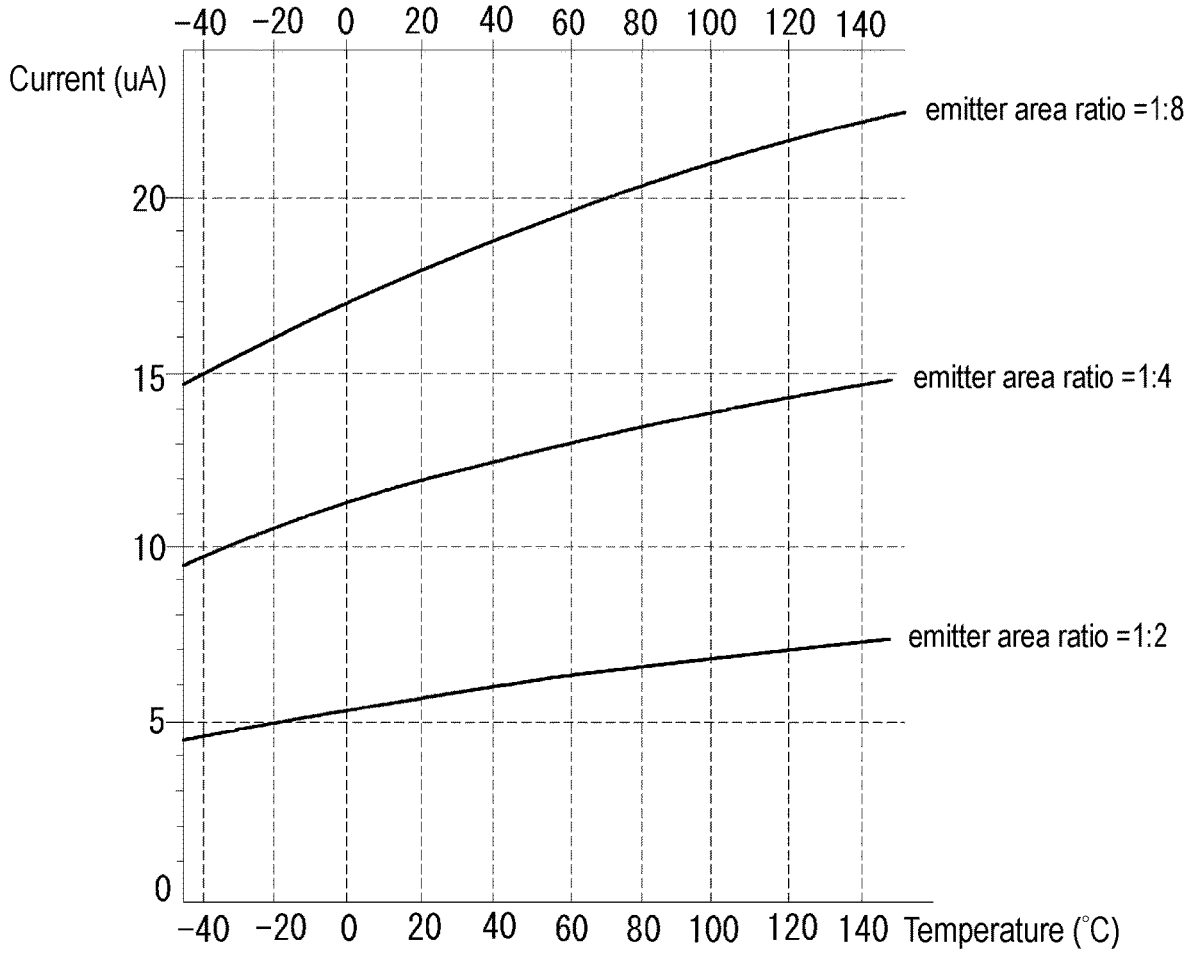
FIG. 2 is a graph showing the relationship between the current flowing through the PTAT shown in FIG. 1 and the temperature.

FIG. 2 is a graph showing the relationship between the current $I_1$ ($=I_2$) flowing in the PTAT current source shown in FIG. 1 and the temperature. The vertical axis represents the current (uA), and the horizontal axis represents the temperature. In addition, the graph shows the relationship between the current and the temperature when the emitter area ratio n is 1:2, 1:4, and 1:8. The current $I_1$ has a positive temperature coefficient with respect to the absolute temperature, and the magnitude of the current is substantially proportional to the emitter area ratio n. However, when the emitter area ratio is different, the temperature coefficient is also slightly different, such that the ratios are approximate and not exactly proportional. Table 1 shows the relationship between the emitter area ratio and the temperature coefficient in the temperature range of −45° C. to 52.5° C. of the graph in FIG. 2. As the emitter area ratio increases, the temperature coefficient decreases.

TABLE 1

| Emitter Area Ratio (1:n) | Temperature Coefficient (45° C.~52.5° C.) |
|---|---|
| 1:8 | 2838 (ppm/K) |
| 1:4 | 2960 (ppm/K) |
| 1:2 | 3343 (ppm/K) |

In this embodiment, two PTAT current sources are adapted to generate a temperature-compensated current by the difference of the two currents. As described above, when the emitter area ratio is different, the temperature coefficients of the two are also slightly different, but with the difference between the two currents, it is possible to find that the current hardly changes with respect to temperature. In an embodiment, the magnitude of the current of one or both of the two PTAT current sources can be adjusted proportionally, such that the temperature coefficient of the differential current is close to zero, so as to generate a high-precision, temperature-compensated current.

Figure 3:
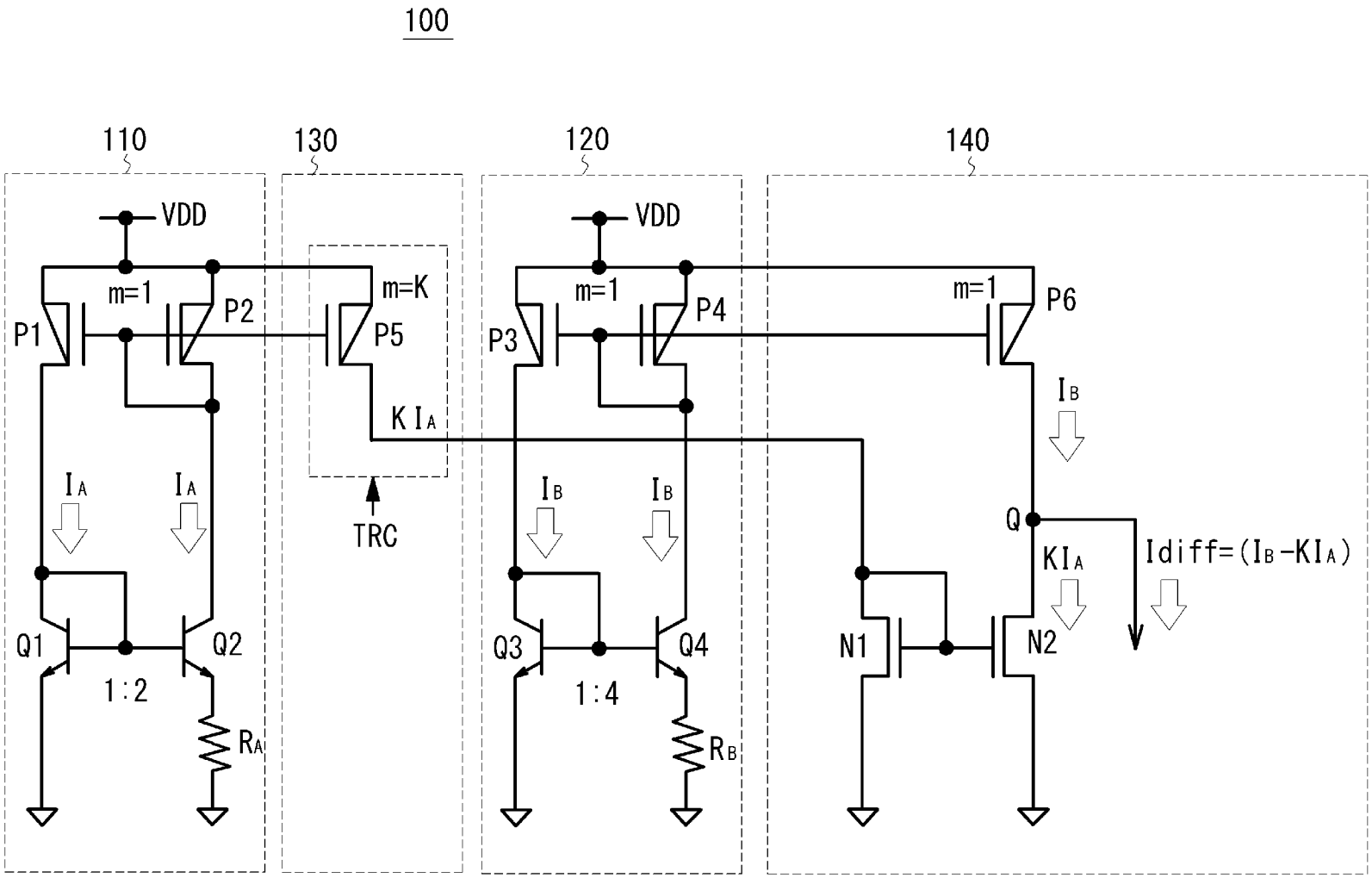
FIG. 3 is a diagram showing a configuration of a temperature compensation circuit according to an embodiment of the disclosure.

Next, the temperature compensation circuit of the present embodiment is described in detail. FIG. 3 is a diagram showing a configuration of a temperature compensation circuit according to an embodiment of the disclosure. The temperature compensation circuit 100 of this embodiment includes a first PTAT current source 110, a second PTAT current source 120, an adjustment circuit 130, and a differential circuit 140. The first PTAT current source 110 generates a current $I_A$ with a temperature coefficient proportional to the absolute temperature. The second PTAT current source 120 generates a current $I_B$ with a temperature coefficient proportional to the absolute temperature. The adjustment circuit 130 adjusts the magnitude of the current $I_A$ generated by the first PTAT current source 110 to be K times to generate the adjusted current $KI_A$. The differential circuit 140 outputs the difference between the adjusted current $KI_A$ and the current $I_B$ generated by the second PTAT current source 120.

The first PTAT current source 110 includes a first current path and a second current path between the supply voltage VDD and the GND. A PMOS transistor P1 and an NPN bipolar transistor Q1 are connected in series on the first current path. The PMOS transistor P2, the NPN bipolar transistor Q2, and the resistor $R_A$ are connected in series on the second current path. The transistor P1 and the transistor P2 form a current mirror with a mirror ratio of 1 (m=1), and function as a current source for flowing a current $I_A$ to each of the first current path and the second current path. In the bipolar transistor Q1 and the bipolar transistor Q2, the respective bases are commonly connected to the first current path, performing a diode connection, and the emitter area ratio n of the bipolar transistor Q1 and the bipolar transistor Q2 is, for example, 1:2. The resistor $R_A$ is not particularly defined and is composed of, for example, a resistor having a positive temperature characteristic or a resistor made of a semiconductor material having a negative temperature characteristic.

Similar to the first PTAT current source 110, the second PTAT current source 120 includes a first current path and a second current path between the supply voltage VDD and the supply voltage GND. A PMOS transistor P3 and an NPN bipolar transistor Q3 are connected in series on the first current path. The PMOS transistor P4, the NPN bipolar transistor Q4, and the resistor $R_B$ are connected in series on the second current path. The transistor P3 and the transistor P4 form a current mirror with a mirror ratio of 1 (m=1), and function as a current source for flowing a current $I_B$ to the first current path and the second current path. In the bipolar transistor Q3 and the bipolar transistor Q4, the respective bases are commonly connected to the first current path, performing a diode connection, and the emitter area ratio n of the transistor Q3 and the transistor Q4 is, for example, 1:4. The resistor $R_B$ is configured to have the same resistance value as resistor $R_A$ ($R_B$=$R_A$).

Figure 4A:
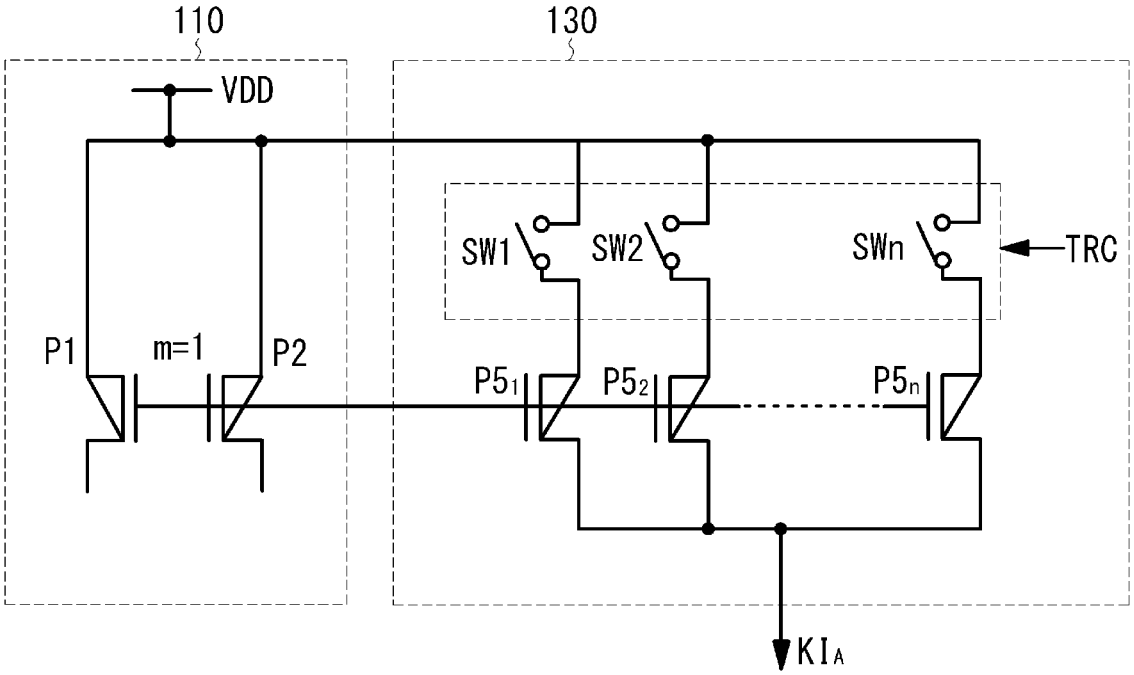
FIG. 4A and FIG. 4B are diagrams showing an example of an adjustment circuit according to an embodiment of the disclosure.

The adjustment circuit 130 adjusts the magnitude of the current $I_A$ generated by the first PTAT current source 110. In this example, the adjustment circuit 130 includes a PMOS transistor P5 that forms a current mirror with the PMOS transistor P1 and the PMOS transistor P2 to adjust a mirror ratio K (m=K; K is a value greater than 1) of the transistor P5. The adjustment scheme of the mirror ratio K is not particularly defined. The adjustment circuit 130 includes, for example, logic for adjusting the mirror ratio K based on a trim code (TRC) supplied externally or a trim code TRC stored in advance in a storage unit, such as a memory. For example, as shown in FIG. 4A, the adjustment circuit 130 includes a plurality of transistors $P5_1$ to $P5_n$ in which n number of transistors P5 are connected in parallel, and switches SW1 to SWn are connected in series to these transistors. The witches SW1 to SWn are selectively turned on and off according to the trim code TRC. As a result, the sum of the drain currents of the transistors conducted becomes the adjusted current $KI_A$. As such, a mirror current $K \times I_A$ that is K times the current $I_A$ is generated at the drain of the transistor P5.

The differential circuit 140 includes a first current path and a second current path between the supply voltage VDD and the supply voltage GND. The first current path includes an NMOS transistor N1 connected in series with the transistor P5 of the adjustment circuit 130. The current $KI_A$ from the transistor P5 is supplied to the first current path. The second current path includes: a PMOS transistor P6 that forms a current mirror with the transistor P3 and the transistor P4 of the second PTAT current source and has a mirror ratio of 1 (m=1); and an NMOS transistor N2 connected in series to the PMOS transistor P6. The current $I_B$ from the transistor P6 is supplied to the second current path. In the transistor N1 and the transistor N2, the respective gates are commonly connected to the first current path to form a current mirror circuit. As such, the differential current Idiff ($I_B$−$KI_A$) of the current $I_B$ and the current $KI_A$ is output externally from a connection node Q of the transistor P6 and the transistor N2.

The current $I_A$ is approximately $I_B/2$ according to the emitter area ratio of the NPN bipolar transistor, but the temperature coefficient (Tco) of the current $I_A$ is larger than the temperature coefficient (Tco) of the current $I_B$. If the mirror ratio K of the adjustment circuit 130 is selected in a way that the temperature gradient of the current $KI_A$ with respect to the absolute temperature is approximately the same as that of the current $I_B$, the temperature dependence of the differential current Idiff may be brought close to zero.

Figure 5:
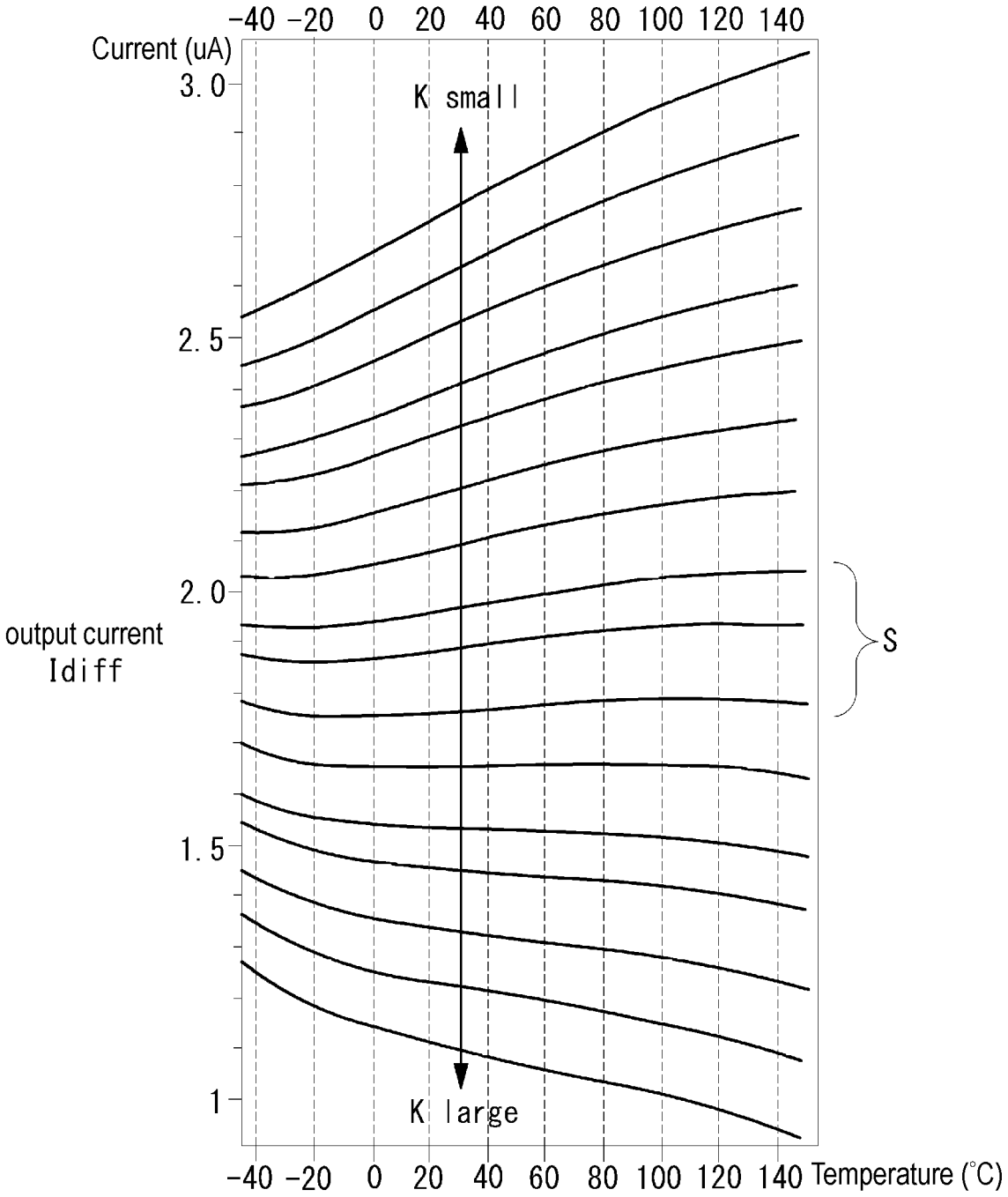
FIG. 5 is a graph showing the relationship between the output current Idiff and the temperature according to the embodiment of the disclosure.

FIG. 5 is a graph showing the relationship between the differential current Idiff and the temperature when the mirror ratio K is changed in the actual temperature compensation circuit 100. When the mirror ratio K is reduced, the influence of the current $I_B$ is relatively increased. Therefore, the output current Idiff increases in a positive direction as the temperature increases. When the mirror ratio K is increased, the influence of the current $KI_A$ is relatively increased. Therefore, the output current Idiff advances in the direction of decreasing current as the temperature increases. Therefore, as long as the mirror ratio K is selected in the middle between the range that changes in the positive direction and the range that changes in the negative direction (e.g., the range denoted by S in FIG. 5), the temperature change of the output current Idiff may be close to zero.

As such, according to the temperature compensation circuit of the present embodiment, it is possible to obtain a temperature-compensated constant current with higher accuracy than conventional ones by utilizing the difference in the temperature coefficients of the two PTAT current sources.

In the embodiment described, the NPN bipolar transistor Q1, the NPN bipolar transistor Q2, the NPN bipolar transistor Q3, and the NPN bipolar transistor Q4 are used in the first PTAT current source 110 and the second PTAT current source 120, but these transistors may also be replaced with diode-connected PNP bipolar transistors. Furthermore, NPN bipolar transistors may also be replaced with diodes. In this case, the emitter area ratio is equivalent to the number ratio of diodes connected in parallel.

In the embodiment, the emitter area ratio of the first PTAT current source 110 is 1:2, and the emitter area ratio of the second PTAT current source 120 is 1:4. However, these emitter area ratios are but an example, and there may be other emitter area ratios adoptable. For example, the emitter area ratio of the first PTAT current source 110 may 1:4, and the emitter area ratio of the second PTAT current source 120 may 1:8.

An example of adjusting the current $I_A$ generated by the first PTAT current source 110 is shown in the embodiment described, but the current $I_B$ generated by the second PTAT current source 120 may also be adjusted. In this case, the adjustment circuit 130 adjusts the mirror ratio of the transistor P6 that forms the current mirror with the transistor P3 and the transistor P4 to be m=K', and provides the adjusted current $K'I_B$ to the second current path of the differential circuit 140. In addition, the adjustment circuit 130 may also adjust both the current $I_A$ and the current $I_B$, and provide the adjusted current $KI_A$ and the current $K'I_B$ to the first current path and the second current path of the differential circuit 140.

An example of supplying the current $I_B$ with the transistor P6 to the second current path of the differential circuit 140 is shown in the embodiment described, but the transistor P6 is not necessarily required. For example, the current $I_B$ generated from the transistor P4 of the second PTAT current source 120 may be directly supplied to the differential circuit 140. In addition, the configuration of the differential circuit 140 is but an example. Other current differential circuits may also be adopted.

Figure 6:
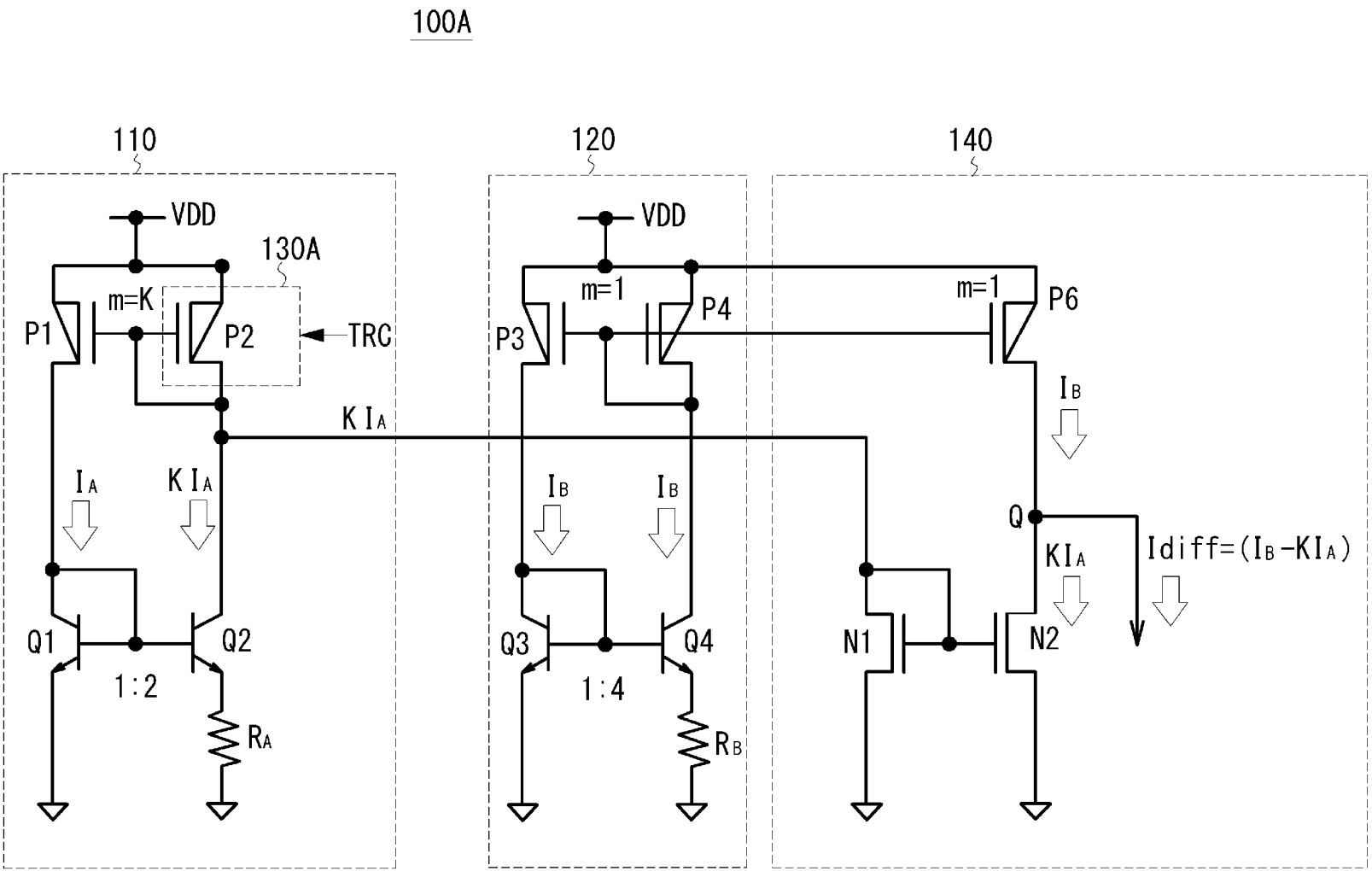
FIG. 6 is a diagram showing a modification of the adjustment circuit of the temperature compensation circuit according to an embodiment of the disclosure.

A modification of the adjustment circuit of the temperature compensation circuit of the present embodiment is described hereinafter with reference to FIG. 6. In the embodiment, the adjustment circuit 130 includes a PMOS transistor P5 constituting a current mirror. In this example, the first PTAT current source 110 shown in FIG. 6 includes an adjustment circuit 130A. Except for the configuration mentioned above, the rest of the configuration is the same as that in FIG. 3.

In the first PTAT current source 110, the mirror ratio of the transistor P2 constituting the current mirror circuit is adjusted to K (m=K). The adjustment circuit 130A adjusts the mirror ratio K of the transistor P2 according to the trim code TRC (e.g., the adjustment scheme as shown in FIG. 4A), and provides the adjusted mirror current $KI_A$ to the differential circuit 140. By removing the transistor P5 that constitutes the current mirror, the configuration of the temperature compensation circuit 100A is simplified, thereby saving more space.

In addition, in the case of adjusting the current $I_B$ of the second PTAT current source 120, the mirror ratio of the transistor P4 that constitutes the current mirror circuit may also be adjusted to K' in the second PTAT current source 120 using the same scheme as above, and the adjusted mirror current $K'I_B$ may be then provided to the second current path of the differential circuit 140.

Figure 7:
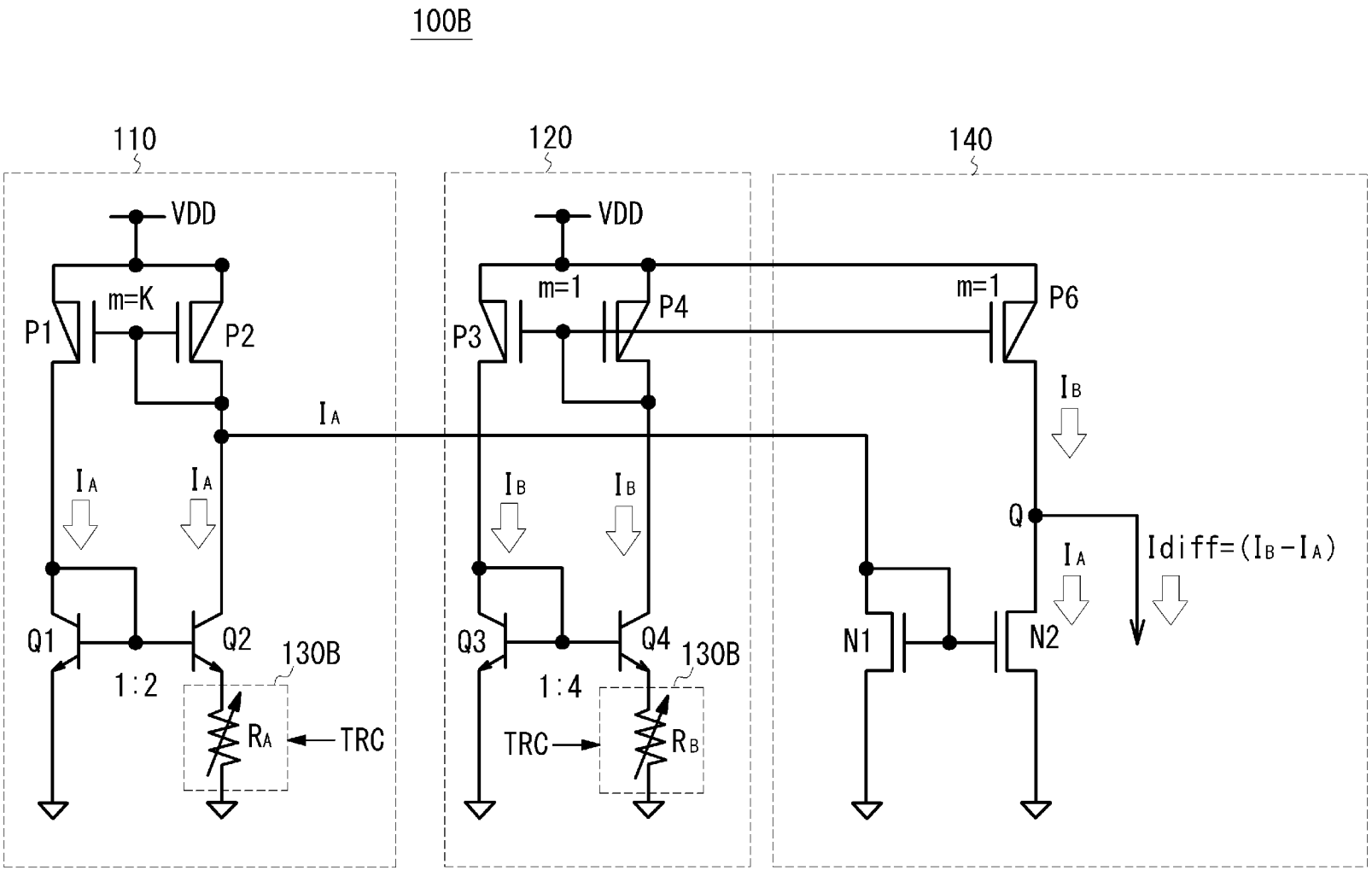
FIG. 7 is a diagram showing another modification of the adjustment circuit of the temperature compensation circuit according to an embodiment of the disclosure.

Another modification of the adjustment circuit of the temperature compensation circuit of the present embodiment is described hereinafter with reference to FIG. 7. In the temperature compensation circuit 100B of this modification, an adjustment circuit 130B adjusts the magnitudes of the current $I_A$ and the current $I_B$ that are proportional to the absolute temperature by changing the resistance value of the resistor $R_A$ of the first PTAT current source 110 and/or the resistance value of the resistor $R_B$ of the second PTAT current source 120.

Figure 4B:
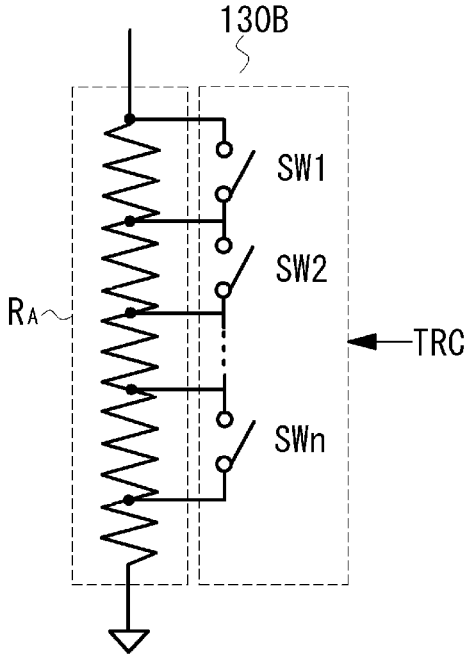

As the resistor $R_A$ and the resistor $R_B$ are variable resistors, the adjustment circuit 130B may change the resistance values of the resistor $R_A$ and the resistor $R_B$ according to the trim code TRC. However, the adjustment scheme of the resistor may be chosen as needed. For example, as shown in FIG. 4B, the adjustment circuit 130B is connected to a switch SW1, a switch SW2, . . . , and a switch SWn at multiple terminal positions of the resistor $R_A$, and the resistance value is changed by selectively turning on the switches SW1 to SWn according to the trim code TRC to short-circuit part of the resistor $R_A$.

In this example, the adjustment circuit 130B adjusts the resistor $R_A$ or the resistor $R_B$. However, if it is necessary to make the temperature change of the differential current Idiff close to zero, the adjustment circuit 130B may also adjust the mirror ratio K simultaneously with the adjustment of the resistor $R_A$ and the resistor $R_B$ as shown in FIG. 3 or FIG. 6.

Figure 8:
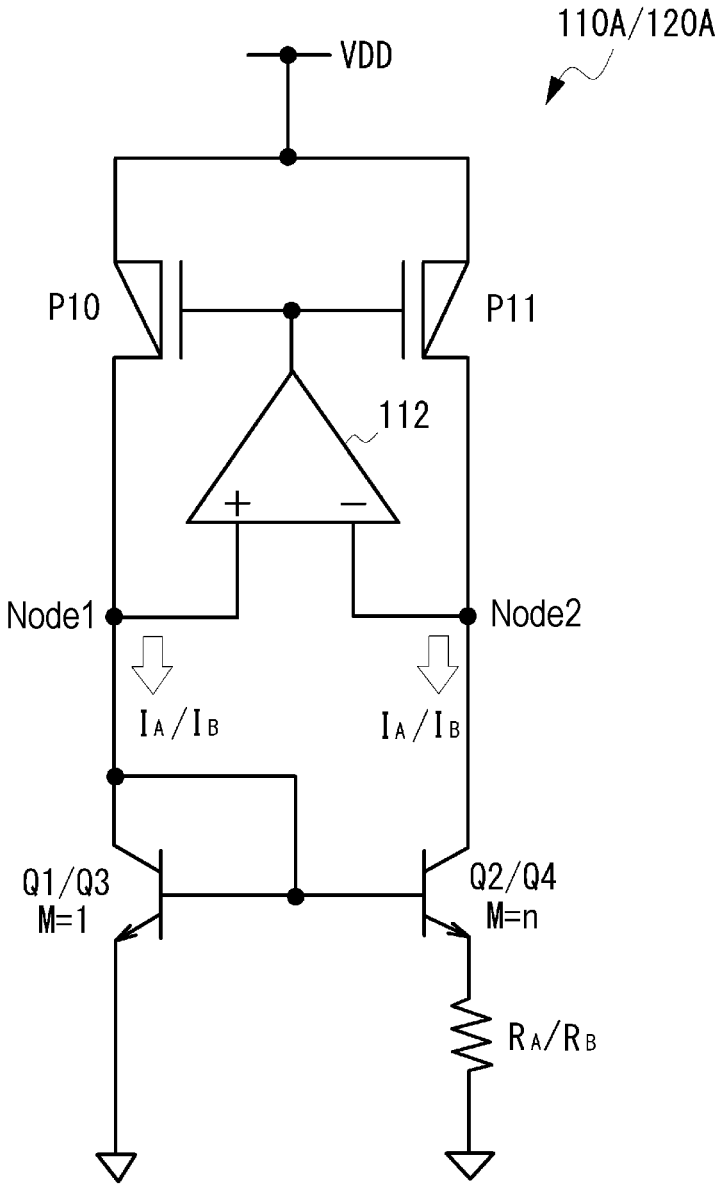
FIG. 8 is a diagram showing a modification of the PTAT current source of the temperature compensation circuit according to an embodiment of the disclosure.

A modification of the PTAT current source of the temperature compensation circuit of the present embodiment is described hereinafter with reference to FIG. 8. The first PTAT current source 110 and the second PTAT current source 120 control the current $I_A$ and the current $I_B$ using the current mirror circuit of the PMOS transistor, which may be replaced by an operational amplifier current mirror. The first PTAT current source 110A and the second PTAT current source 120A include a PMOS transistor P10, a PMOS transistor P11 (having the same configuration as the transistor P10), and an operational amplifier 112. The PMOS transistor P10 and the PMOS transistor P11 are connected to the supply voltage VDD. The operational amplifier 112 is connected to a node Node1 to the non-inverting input terminal (+) and a node Node2 to the inverting input terminal (−), and the output terminals are commonly connected to the gates of a transistor P10 and a transistor P11. The operational amplifier 112 controls the gate voltages of the transistor P10 and the transistor P11 to equal the voltage of the node Node1 and the voltage of the node Node2, such that equal current $I_A$ and current $I_B$ flow through the first current path and the second current path. Compared to the previous embodiment, equal current $I_A$/current $I_B$ with high precision is generated on the first current path and the second current path by using the operational amplifier 112.

Although the embodiments of the disclosure has been described in detail, the disclosure is not limited to these embodiments, and various modifications and changes can be made within the scope of the disclosure described in the claims.

What is claimed is:

1. A temperature compensation circuit, comprising:

a first circuit employing transistors with a first emitter area ratio or diodes with a number ratio equivalent to the first emitter area ratio to generate a first current, the first current having a first temperature coefficient proportional to an absolute temperature;

a second circuit employing transistors with a second emitter area ratio or diodes with a number ratio equivalent to the second emitter area ratio to generate a second current, the second current having a second temperature coefficient proportional to the absolute temperature, wherein the first emitter area ratio of the first circuit is different from the second emitter area ratio of the second circuit, the first current is proportional to the first emitter area ratio, and the second current is proportional to the second emitter area ratio; and a differential circuit configured to output a differential current of the first current and the second current, wherein the differential circuit comprises:

a first transistor comprising a first end, a second end and a control end, wherein the first end of the first transistor is coupled to a first supply voltage, and the control end of the first transistor is coupled to the second circuit;

a second transistor comprising a first end, a second end and a control end, wherein the first end of the second transistor is coupled to the first circuit, the second end of the second transistor is coupled to a second supply voltage, and the control end of the second transistor is coupled to the first end of the second transistor, wherein the first supply voltage is larger than the second supply voltage; and a third transistor comprising a first end, a second end and a control end, wherein the first end of the third transistor is coupled to the second end of the first transistor, the second end of the third transistor is coupled to the second supply voltage, and the control end of the third transistor is coupled to the control end of the second transistor, wherein the differential current is outputted from the first end of the third transistor.

2. The temperature compensation circuit of claim 1, wherein the first circuit and the second circuit respectively comprise a fourth transistor, a fifth transistor, and an operational amplifier, one ends of the fourth transistor and the fifth transistor are connected to the first supply voltage, a non-inverting input terminal of the operational amplifier is connected to a first node, an inverting input terminal of the operational amplifier is connected to a second node, and an output terminal of the operational amplifier is commonly connected to gates of the fourth transistor and the fifth transistor, the operational amplifier controls gate voltages of the fourth transistor and the fifth transistor by equaling a voltage of the first node and a voltage of the second node.

3. The temperature compensation circuit of claim 1, further comprising:

an adjustment part configured to adjust a magnitude of the first current or the second current.

4. The temperature compensation circuit of claim 3, wherein the adjustment part adjusts the magnitude of the first current or the second current with a current mirror circuit.

5. The temperature compensation circuit of claim 3, wherein the adjustment part adjusts a resistance value of a resistor.

6. The temperature compensation circuit of claim 5, wherein the adjustment part comprises a plurality of switches, and each of the switches is selectively turned on according to a trim code to change the resistance value of the resistor.

7. The temperature compensation circuit of claim 1, wherein the first circuit comprises a first current mirror circuit supplying the first current as a current source, and the second circuit comprises a second current mirror circuit supplying the second current as a current source.

8. The temperature compensation circuit of claim 7, wherein an adjustment part adjusts a mirror ratio of the first current minor circuit or the second current mirror circuit.

9. The temperature compensation circuit of claim 8, wherein the adjustment part adjusts the mirror ratio of the first current mirror circuit according to a trim code, and the adjusted first current is supplied to the differential circuit.

10. The temperature compensation circuit of claim 7, wherein an adjustment part comprises a fourth transistor forming a current mirror with the first current mirror circuit or the second current mirror circuit, and adjusts a mirror ratio of the fourth transistor.

11. The temperature compensation circuit of claim 10, wherein the adjustment part comprises a plurality of the fourth transistor connected in parallel and forming a current minor with the first current mirror circuit or the second current mirror circuit, and a plurality of switches respectively connected in series to the fourth transistor, and the minor ratio of the fourth transistor is adjusted by each of the switches being selectively turned on according to a trim code.

12. The temperature compensation circuit of claim 10, wherein the differential circuit comprises a first current path and a second current path, the first current path comprises the second transistor connected in series with the fourth transistor of the adjustment part, and is supplied with current from the fourth transistor, the second current path comprises the first transistor forming a current mirror with the second current mirror circuit, and the third transistor connected in series to the first transistor, and is supplied with current from the first transistor, a gate of the second transistor and a gate of the third transistor are commonly connected to the first current path to form a current mirror.

13. The temperature compensation circuit of claim 1, wherein the transistors are NPN or PNP bipolar transistors.

14. A semiconductor integrated circuit, comprising:

the temperature compensation circuit of claim 1; and a voltage generation circuit configured to generate a voltage based on the differential current output by the temperature compensation circuit.

15. A temperature compensation circuit, comprising:

a first proportional-to-absolute-temperature (PTAT) circuit employing transistors with a first emitter area ratio or diodes with a number ratio equivalent to the first emitter area ratio and a first resistor to generate a first current, the first current having a positive temperature coefficient with respect to an absolute temperature;

a second PTAT circuit employing transistors with a second emitter area ratio or diodes with a number ratio equivalent to the second emitter area ratio and a second resistor to generate a second current, the second current having a positive temperature coefficient with respect to the absolute temperature; and a differential circuit configured to output a differential current of the first current and the second current, wherein the first emitter area ratio of the first PTAT circuit is different from the second emitter area ratio of the PTAT second circuit, the first current is substantially proportional to the first emitter area ratio, the second current is substantially proportional to the second emitter area ratio, wherein as the first emitter area ratio increases, the first temperature coefficient decreases, and as the second emitter area ratio increases, the second temperature coefficient decreases; and an adjustment part configured to adjust a magnitude of the first current, so that a temperature gradient of the first current with respect to the absolute temperature is approximately the same as that of the second current when the second emitter area ratio of the second PTAT circuit is larger than the first emitter area ratio of the first PTAT circuit.

16. The temperature compensation circuit of claim 15, wherein the first resistor and the second resistor have a same resistance value.

17. The temperature compensation circuit of claim 15, wherein the adjustment part is configured to adjust a magnitude of the first current or the second current.

18. The temperature compensation circuit of claim 15, wherein the first PTAT circuit comprises a first current mirror circuit supplying the first current as a current source, and the second PTAT circuit comprises a second current mirror circuit supplying the second current as a current source.

19. The temperature compensation circuit of claim 15, wherein the first PTAT circuit comprises a first current mirror circuit supplying the first current as a current source, and the second PTAT circuit comprises a second current mirror circuit supplying the second current as a current source, and the adjustment part adjusts a mirror ratio of the first current minor circuit or the second current minor circuit.

* * * * *